US005124750A

United States Patent [19]

Naito

[11] Patent Number: 5,124,750

[45] Date of Patent: Jun. 23, 1992

[54] TONER DENSITY DETECTING METHOD, AND IMAGE FORMING METHOD AND APPARATUS EMPLOYING THE TONER DENSITY DETECTING METHOD

[75] Inventor: Yoshikazu Naito, Gamagori, Japan

[73] Assignee: Minolta Camera Kabushiki Kaisha, Osaka, Japan

[21] Appl. No.: 575,810

[22] Filed: Aug. 31, 1990

[30] Foreign Application Priority Data

Sep. 5, 1989 [JP] Japan ..... 1-231159
Sep. 5, 1989 [JP] Japan ..... 1-231160
Sep. 5, 1989 [JP] Japan ..... 1-231161

[51] Int. Cl.[5] ..... G03G 21/00

[52] U.S. Cl. ..... 355/246; 355/326; 355/77

[58] Field of Search ..... 355/246, 245, 326, 327, 355/77; 118/645-658, 691

[56] References Cited

U.S. PATENT DOCUMENTS

| | | | |
|---|---|---|---|
| Re. 32,330 | 1/1987 | Miyakawa et al. | 355/219 |
| 3,815,988 | 6/1974 | McVeigh et al. | 355/246 |
| 4,226,525 | 10/1980 | Sakamoto et al. | 355/246 |
| 4,272,182 | 6/1981 | Abe et al. | 355/246 |
| 4,277,162 | 7/1981 | Kasahara et al. | 355/208 |
| 4,304,486 | 12/1981 | Cormier et al. | 355/246 |
| 4,313,671 | 2/1982 | Kuru | 355/14 D |
| 4,318,610 | 3/1982 | Grace | 355/246 |
| 4,341,461 | 7/1982 | Fantozzi | 355/246 |
| 4,416,535 | 11/1983 | Tottori | 355/246 |
| 4,466,731 | 8/1984 | Champion et al. | 355/246 |
| 4,522,481 | 6/1985 | Imai et al. | 355/246 |
| 4,533,234 | 8/1985 | Watai et al. | 355/246 |
| 4,539,279 | 9/1985 | Murai et al. | 118/688 X |
| 4,796,065 | 1/1989 | Kanbayashi | 355/14 E |
| 4,829,336 | 5/1989 | Champion et al. | 355/246 |
| 4,866,481 | 9/1989 | Yamada et al. | 355/246 |
| 4,870,460 | 9/1989 | Harada et al. | 355/246 |
| 4,879,577 | 11/1989 | Mabroak et al. | 355/208 |
| 4,894,685 | 1/1990 | Sheji et al. | 355/246 |
| 4,959,669 | 9/1990 | Haneda et al. | 355/326 X |
| 4,970,536 | 11/1990 | Haneda et al. | 355/246 X |

*Primary Examiner*—R. L. Moses
*Attorney, Agent, or Firm*—Burns, Doane, Swecker & Mathis

[57] ABSTRACT

A method of detecting the toner density of a standard test toner image which comprises the steps of forming on the photosensitive drum a saturated test toner image from which the amount of diffused light is to be measured as a saturation level as well as the standard test toner image, and evaluating the measurement of the amount of diffused light from the standard test toner image in accordance with the measurement of the amount of diffused light from the saturated test toner image. In an image forming method or image forming apparatus which employs this toner density detecting method, the standard test toner image is formed on the photosensitive drum with a specified voltage of developing bias impressed, and an optimum developing bias voltage is calculated from the measurement of the amount of diffused light from the saturated test toner image and the measurement of the amount of diffused light from the standard test toner image. Such a process is carried out prior to an image forming operation.

21 Claims, 9 Drawing Sheets

FIG. 2
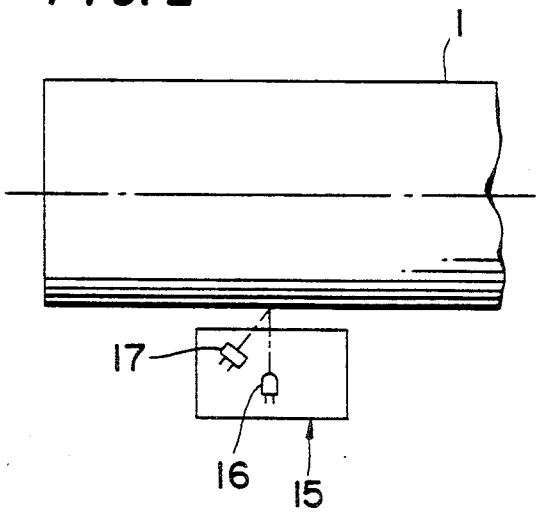
FIG. 3
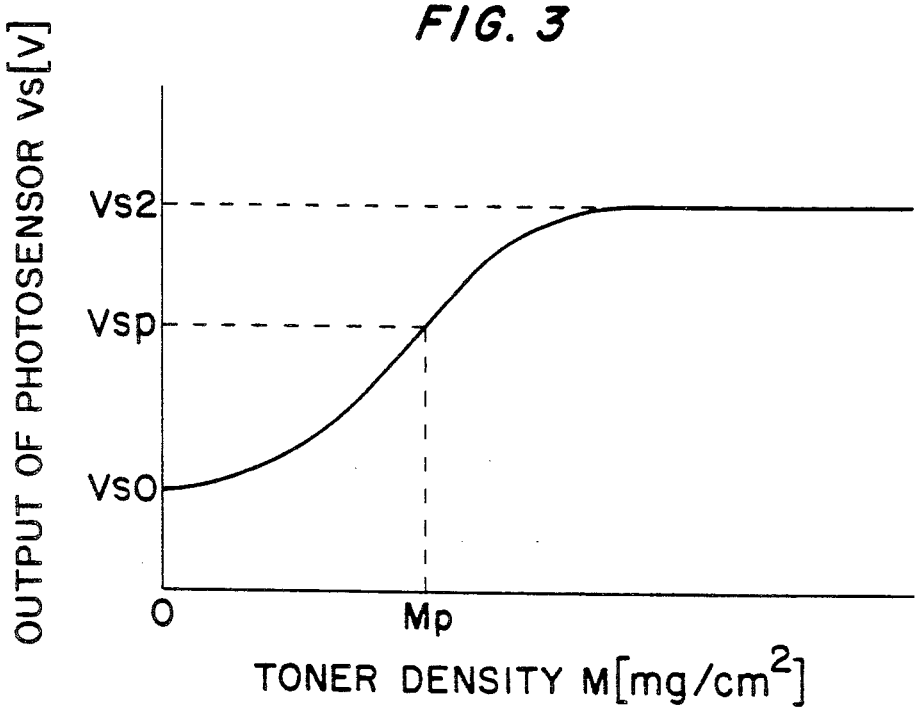
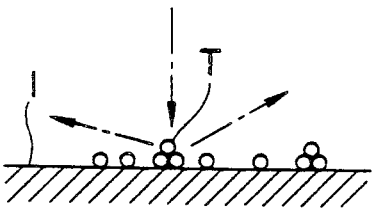
FIG. 4a
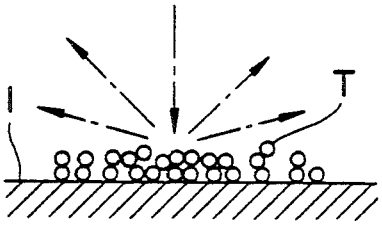
FIG. 4b

TONER DENSITY DETECTING METHOD, AND IMAGE FORMING METHOD AND APPARATUS EMPLOYING THE TONER DENSITY DETECTING METHOD

BACKGROUND OF THE INVENTION

1. Field of the Invention

The present invention relates to a method of detecting the density of toner deposited on an image recording member, and a toner image transferring type image forming method and image forming apparatus for which the toner density detecting method is employed.

2. Description of Related Art

In using a toner image transferring type of image forming apparatus such as an electrophotograchic copying machine, a laser printer, etc., an uniform amount of toner must be always stuck on the photosensitive member in order to keep forming quality images in density and chromaticity. The amount of toner stuck on the photosensitive member varies according to the electro static charge on the toner which also varies mainly according to circumstances such as humidity, temperature, etc. A feedback system, as for 1) forming a test toner image on the photosensitive member, 2) measuring the density of toner deposited on the photosensitive member optically and 3) transmitting the measured density to a controller for determining a toner density in the developer and a controller for determining a developing bias voltage, has been proposed in various forms. In measuring the density of toner deposited on the photosensitive member with a photosensor, however, errors are caused by changes of the photosensor in characteristic due to fatigue and smudges on the photosensor (mainly due to toner smoke).

U.S. Pat. No. 4,313,671 discloses a second photosensor for measuring reflected light from the surface of the photosensitive member as well as a first photosensor for measuring the density of toner deposited on the photosensitive member, and it also teaches that the measurement with the first photosensor is evaluated in accordance with the measurement with the second photosensor and that the evaluated value is used for controlling a toner supply Even with this arrangement, if the Photosensitive member has a stain or a scratch, errors are apt to occur. In detecting the density of color toner deposited on the photosensitive member by measuring the amount of diffused light, the output of a sensor which measures the amount of diffused light from the photosensitive member is too small to detect the density accurately.

In a conventional feedback system, either a value obtained from only one test toner image or a value obtained from a few test toner images which are formed under the same conditions is used for determining a developing bias voltage (refer to Japanese Patent Laid-Open Publication No. 56-33661). When the toner density/densities of the test toner image(s) is/are in either so low a level or so high a level that the toner density/densities can not bring about variations in measurements, (an) error(s) in measuring the toner density/densities is/are caused, and nothing compensates for the error(s). Consequently, it is very difficult to determine an optimum developing bias voltage accurately.

According to a conventional feedback system, the detection of the toner density of a test toner image is performed, every time an image is to be formed, immediately after the machine is supplied with power, or immediately before a multiple copying operation is started. A machine in which a system of detecting the toner density of a test toner image every time an image is to be formed is employed is inferior in copying speed. Especially when such a system is applied to a full-color copying machine wherein each of the developing devices is set to a developing position before each developing operation, the copying speed will be quite slow. From this point of view, this type of machine should be provided with such a feedback system as the toner density of a test toner image is detected immediately after a power supply for the machine and after the completion of a multiple copying operation, and the detected value is applied to the next copying operation. With this arrangement, however, when the next copying operation is started a long time after the former operation was finished, circumstances (humidity, temperature, etc.) may change, and the developing bias voltage determined in accordance with the value measured long ago may be improper in the current circumstances.

SUMMARY OF THE INVENTION

It is therefore an object of the present invention to provide a toner density detecting method where the toner density of a standard test toner image can be detected accurately regardless of smudges on the optical elements for measuring the toner density and the condition of the surface of the photosensitive member (stains or scratches on the surface).

It is another object of the present invention to provide an image forming method and image forming apparatus where the toner density of a test toner image can be detected accurately regardless of smudges on the optical elements for measuring the toner density and the condition of the surface of the photosensitive member, and the detected value is used for controlling developing bias, toner supply for the developing device, exposure or charge to obtain finished images having proper toner density and chromaticity all the time.

It is also an object of the present invention to provide an image forming method and image forming apparatus where an error in detecting the toner density of a test toner image is effectively compensated, and the accurately detected value is used for controlling developing bias to obtain finished images having proper toner density and chromaticity all the time.

Further, it is an object of the present invention to provide an image forming method and image forming apparatus where reduction in image forming speed due to the detection of the toner density of a test toner image is avoided as much as possible, and there is a system to react to a change in the characteristic of the toner due to a change in circumstances when an image forming operation is to be started long after the former operation so that finished images having proper density and chromaticity are obtained all the time.

In order to attain the above-described objects, a toner density detecting method according to the present invention comprises the steps of forming on an image recording member a saturated test toner image from which the amount of diffused light is to be measured as a saturation level as well as a standard test toner image; measuring the amount of diffused light from the saturated test toner image; measuring the amount of diffused light from the standard test toner image; and evaluating the measurement of the amount of diffused light from the standard test toner image in accordance with the measurement of the amount of diffused light from the saturated test toner image.

The density of toner stuck on the image recording member during development varies according to circumstances of the apparatus, but the toner density can be detected accurately by comparing the measurements of the amount of diffused light from two kinds of test toner images with each other. The detected value is used for controlling developing bias, toner supply for the developing device, exposure or charge. One of the two kinds of test toner images is a solid toner image from which the amount of diffused light is measured as a saturation level. The measurement is not influenced by a change in characteristic of the optical measuring elements due to smudges on the elements, but the density of toner stuck on the image recording member according to a change in characteristic of the toner due to a change in circumstances such as temperature, humidity, etc. can be detected accurately. Further, the measurement of the amount of diffused light is not influenced by stains and scratches on the image recording member, while the measurement of the amount of reflected light is influenced by them, and therefore measurements in this method are more accurate.

An image forming method according to the present invention comprises the steps of forming on the image recording member a saturated test toner image from which the amount of diffused light is to be measured as a saturation level; measuring the amount of diffused light from the saturated test toner image; forming a standard test toner image on the image recording member with a specified voltage of developing bias impressed; measuring the amount of diffused light from the standard test toner image; and determining an optimum developing bias voltage depending on the measurement of the amount of diffused light from the saturated toner image and the measurement of the amount of diffused light from the standard test toner image. By following the steps above, an optimum developing bias voltage in the current condition of the toner, the condition which changes according to circumstances, can be figured out accurately regardless of smudges on the optical measuring elements. Thereby, a specified toner density can be always maintained, and finished images having proper toner density and chromaticity are always obtainable.

The image forming method according to the present invention further comprises the steps of forming another standard test toner image with the determined voltage of developing bias impressed; measuring the amount of diffused light from the newly formed standard test toner image; and adjusting the developing bias voltage determined in the developing bias voltage determining step in accordance with the measurement of the amount of diffused light from the saturated test toner image and the measurement of the amount of diffused light from the newly formed standard test toner image. In this method, from the measurement of the amount of diffused light from the first standard test toner image and the measurement of the amount of diffused light from the saturated test toner image, a developing bias voltage which will enable a target toner density is figured out. Next, the second standard test toner image is formed with the calculated voltage of developing bias impressed, and the toner density of the second standard test toner image is detected Then, the developing bias voltage is adjusted in accordance with the detected toner density. With this arrangement, the developing bias is adjustable more minutely to be set to a voltage which enables the target toner density, and this method is useful for adjusting the developing bias in an area where variation in toner density measurement is little.

In the image forming method according to the present invention, the processing flows through the test toner image forming step, the diffused light measuring step and the developing bias voltage determining step either prior to the image forming step and preferably immediately after a power supply for the image forming apparatus, or immediately after the image forming step.

The image forming method according to the present invention further comprises a step of counting an interval at which the processing comes in the image forming step, and when the processing is to come in the image forming step again at an interval of more than a specified time, the processing flows through the test toner image forming step, the diffused light measuring step and the developing bias determining step immediately before the image forming step. With this arrangement, the developing bias can be controlled in accordance with the current circumstances, and finished images having proper toner density and chromaticity are always obtainable.

BRIEF DESCRIPTION OF THE DRAWINGS

These and other objects and features of the present invention will become apparent from the following description taken in conjunction with the preferred embodiments thereof with reference to the accompanying drawings, in which:

FIG. 2 is a view of a photosensor explaining the position thereof;

FIG. 3 is a graph showing correlation between toner density and output of the photosensor;

FIGS. 4*a* and 4*b* are views of toner particles stuck on the photosensitive drum showing the state of diffused light from the particles;

DETAILED DESCRIPTION OF THE PREFERRED EMBODIMENTS

A preferred embodiment of the present invention is hereinafter described in reference with the accompanying drawings.

The following description is of an example of applying the present invention to a copying machine wherein an original document is read by an image reader, a laser beam prints out the read image, and the image is developed in color.

Figure 1:
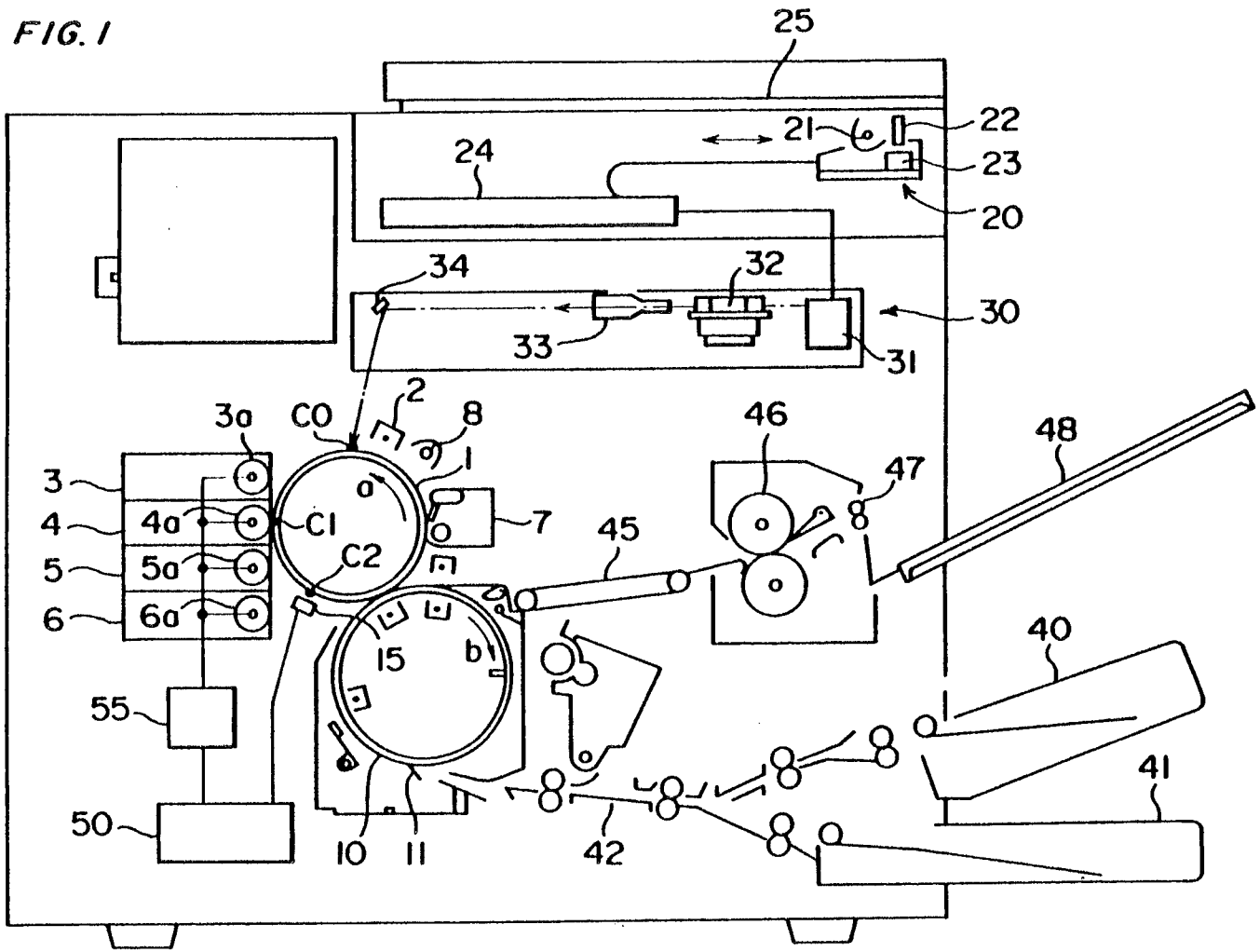
FIG. 1 is a schematic view of a copying machine.

Referring to FIG. 1, a photosensitive drum 1 is rotatable in the direction of arrow (a), and around the photosensitive drum 1 are disposed an electric charger 2, developing devices 3, 4, 5, and 6 which are of magnetic brush type and are put one upon another, a transfer drum 10, a cleaning device 7 and an eraser lamp 8.

Numeral 20 denotes an image reader unit, and it comprises an exposure lamp 21, a lens array 22, a CCD line sensor 23, etc. Also, an image process circuit 24 is incorporated in the unit 20. As the unit 20 is moving to the left in FIG. 1, the line sensor 23 reads the image of an original document placed on the original glass 25 using three color signals, R(red), G(green) and B(blue). The color signals R, G and B are converted into signals, Y(yellow), M(magenta), C(cyan) and Bk(Black) corresponding to toner colors in the image process circuit 24.

Numeral 30 denotes a laser optical system, and it comprises a laser beam radiating section 31, a polygon mirror 32, an $f\theta$ lens 33, a reflection mirror 34, etc. The laser beam radiating section 31 radiates a laser beam in accordance with each of the signals Y, M, C and Bk to form on the photosensitive drum 1 an electrostatic latent image corresponding to the part in each color.

The developing devices 3, 4, 5 and 6 are supplied with developer including yellow toner, magenta toner, cyan toner and black toner respectively. These developing devices 3, 4, 5 and 6 are vertically movable in a body, and each time an electrostatic latent image corresponding to the part in one color is formed, the corresponding developing device 3, 4, 5 or 6 is set to a developing position Cl to develop the latent image.

Meanwhile, copy sheets are fed out of a cassette either 40 or 41 one by one, and each copy sheet passes through a transport path 42 composed of rollers and guide plates to be brought to the transfer drum 10. The leading edge of the sheet is grabbed by a claw 11, and the sheet is wound around the transfer drum 10. Then, the transfer drum 10 is rotated in the direction of arrow (b) in synchronization with the photosensitive drum 1, and a toner image in one color is transferred onto the copy sheet.

With this arrangement, a cycle of processing, charge, exposure, development and transference is repeated four times. After transference of all the toner images was completed, the copy sheet is peeled off the transfer drum 10 and transported to a fixing device 46 through a transport belt 45. The toner images are fixed on the copy sheet by the fixing device 46, and the copy sheet is ejected onto a tray 48 through ejection rollers 47.

The output of a power source unit 55 for imposing developing bias voltages on respective developing sleeves 3*a*, 4*a*, 5*a* and 6*a* of the developing devices 3, 4, 5 and 6 is controlled in order to maintain image density and chromaticity at a specified level. First of all, a test toner image is formed on the photosensitive drum 1, and the density of toner deposited on the drum 1 is detected with a reflective type photosensor 15 which is composed of an LED 16 and a photodiode 17 as shown in FIG. 2. The LED 16 and the photodiode 17 are so arranged that light from the LED 16 irradiates the photosensitive drum 1 and that the photodiode 17 receives diffused light therefrom. In other words, the detection of the toner density of the test toner image formed on the photosensitive drum 1 depends on the LED 16 from which light is radiated towards the photosensitive drum 1 and the photodiode 17 which receives the diffused light therefrom. Reflected light generally includes regular reflection and diffuse reflection. With respect to color toner, an increase of diffuse reflection due to an increase of toner density on the drum 1 is larger than a decrease of regular reflection due to the increase of toner density. Hence, a diffuse reflection receiving system is adopted in this embodiment.

FIG. 3 shows a graph plotting toner density (M) versus output (Vs) of the photosensor 15. Generally, specular reflection on a photosensitive drum is not perfect. Hence, even if toner density on the photosensitive drum 1 is "0", light radiated from the LED 16 is not all regularly reflected, but some irregularly reflected, and consequently the output (Vs) of the photodiode 17 is not 0V but a voltage of Vs0. Referring to FIGS. 4*a* and 4*b*, as toner density is increasing, diffuse reflection increases, and accordingly the output (Vs) of the photosensor 15 goes up. Once toner density reaches a certain level, diffuse reflection from toner particles (T) deposited on the photosensitive drum 1 does not increase any more but keeps a certain level. That is, the output (Vs) of the photosensor 15 reaches a saturation level, and the photosensor 15 keeps generating a voltage of Vs2. In a full-color copying machine, even a slight change in toner density (M) due to the inferiority of the toner and carriers and/or a change in circumstances such as humidity, temperature, etc. influences the density and chromaticity of a finished image.

Figure 5:
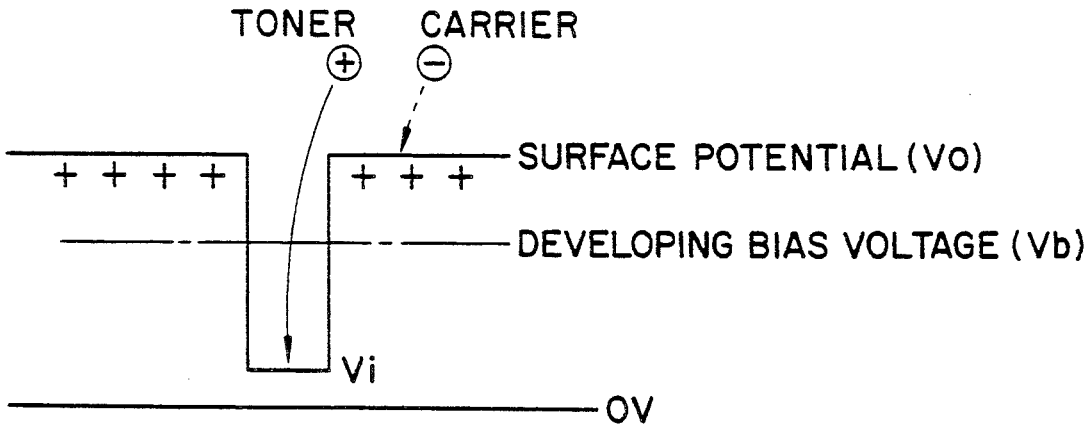
FIG. 5 is an explanatory view of reversal development.

Now referring to FIG. 5, the photosensitive drum 1 is first uniformly charged to have potential of (Vo). Then, the photosensitive drum 1 is exposed to a laser beam in accordance with an image to be copied, and the potential of the exposed part is reduced to (Vi). Thus, an electrostatic latent image is formed. The electrostatic latent image is developed by either one of the developing devices 3, 4, 5 or 6 which is impressed with a voltage (Vb) of developing bias, according to the principles of reversal development. That is, positively charged toner sticks to the imaged part where the potential is (Vi), and a toner image is formed.

Figure 6:
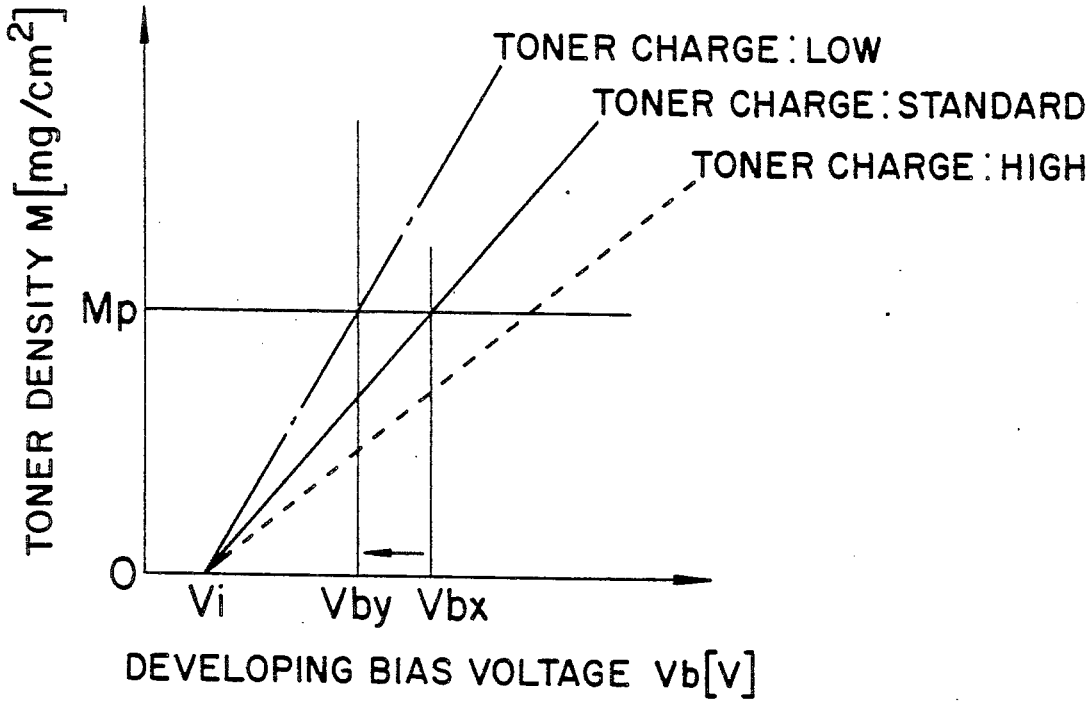
FIG. 6 is a graph showing correlation between developing bias and toner density, the correlation in which toner is in different conditions in charge.

The graph in FIG. 6 shows correlation between developing bias voltage (Vb) and toner density (M) under reversal development. The voltage (Vi) corresponds to the potential of the imaged part (the attenuated potential of the photosensitive drum 1 due to the laser beam irradiation). The solid line A in the graph shows correlation between developing bias voltage (Vb) and toner density (M) when charge (Qf) on the toner is kept in a standard level. In this embodiment, magnetic elements are used for measuring the toner density in the developer, and toner supply is controlled to maintain the toner density in the developer at all times. For this reason, it is not necessary to consider variations in toner charge (Qf) due to variations in toner density in the developer. However, toner charge (Qf) varies also according to humidity and the characteristic of developer. The chain line B in the graph shows correlation between developing bias voltage (Vb) and toner density (M) when toner charge (Qf) is low (when humidity is high or when the characteristic of the developer becomes inferior). The dashed line C in the graph shows correlation between developing bias voltage (Vb) and toner density (M) when toner charge (Qf) is high (when humidity is low). Even when the same voltage of developing bias is impressed, if toner charge (Qf) is low, toner density (M) is high, and if toner charge (Qf) is high, toner density (M) is low. Accordingly, even if the characteristic of the toner changes, it is possible to keep toner density (M) in the same level by controlling developing bias voltage (Vb). Thus, it is possible to stabilize the density and chromaticity of finished images. For instance, even when the toner density characteristic changes from the line A to the line B, a target toner density Mp is obtainable by changing the developing bias voltage from Vbx to Vby. The toner density characteristic denoted by the lines A, B and C is obtainable by experiments beforehand. The toner density of a test toner image which is formed with the voltage Vbx of developing bias impressed is judged from the output of the photosensor 15, referring to FIG. 3. The graph in FIG. 3 shows correlation between toner density (M) and output (Vs) of the photosensor 15 when toner charge (Qf) is in the standard level. Hence, as long as toner charge (Qf) is in the standard level, when a test toner image is formed with the voltage Vbx of developing bias impressed, the target toner density Mp is to be obtained and output of the photosensor 15 at that time is to be a voltage of Vsp. By comparing the actually measured output voltage of the photosensor 15 with the voltage Vsp and referring to FIGS. 3 and 6, the condition of toner charge (Qf) can be judged, and then a developing bias voltage proper for obtaining the target toner density Mp in the condition is to be figured out.

Figure 7:
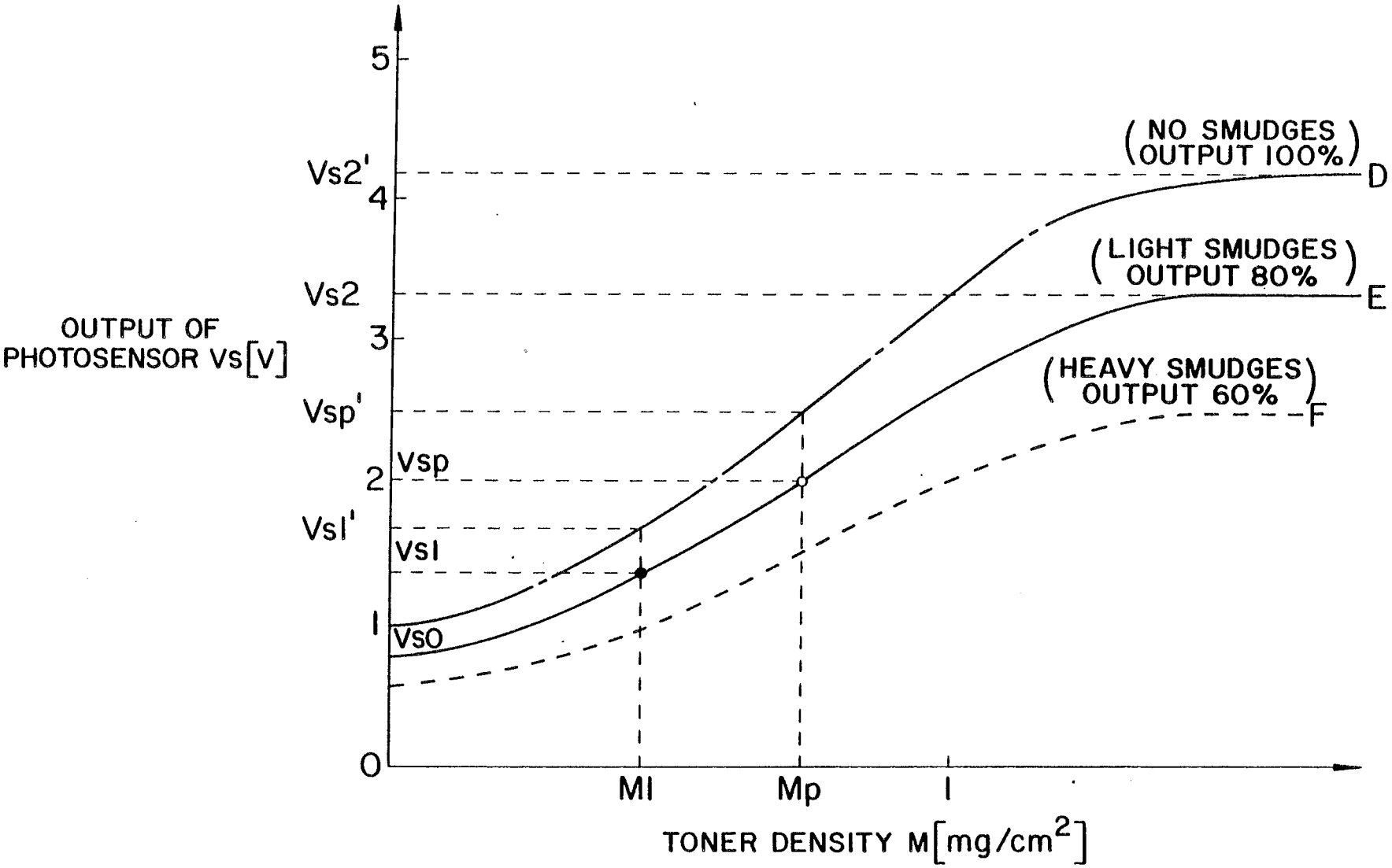
FIG. 7 is a graph showing correlation between toner density and output of the photosensor, the correlation in which the photosensor smudges differently.

However, output of the photosensor 15 varies in voltage also according to stains and smudges on the LED 16 and the photodiode 17 due to toner smoke. FIG. 7 shows correlation between toner density (M) and output (Vs) of the photosensor 15. The chain line D shows correlation between them when the photosensor 15 does not smudge at all and its output is 100%. The solid line E shows correlation between them when the photosensor 15 smudges a little and its output is 80%. The dashed line F shows correlation between them when the photosensor 15 smudges heavily and its output is 60%. While the copying machine is operating, the photosensor 15 smudges more or less. Hence, even when the developing bias voltage Vbx is impressed under the condition that the toner charge (Qf) is in the standard level, the toner density of the test image will not be the target toner density Mp. Accordingly, it is not enough to obtain the target toner density Mp adjusting developing bias voltage (Vb) only to the toner density characteristic in relation to variations in toner charge (Qf). In conditions that toner is normally charged, the output of the photosensor 15 is 80% and the developing bias voltage Vbx is impressed, the toner density is Ml, and the output of the photosensor 15 is measured as a voltage of Vs1. When the target toner density Mp is obtained by adjusting developing bias voltage (Vb) appropriately, the output of the photosensor 15 is measured as a voltage of Vsp. Once the toner density reaches a certain level, the output of the photosensor 15 comes to a saturation level and keeps to be measured as a voltage of Vs2. Correlation between the measured output voltages Vsp and Vs2 is stable as follows, regardless of the level of smudges on the photosensor 15:

$$Vsp/Vs2 = Vsp'/Vs2' = k$$

$$\therefore Vsp = k\ Vs2$$

$$(0 < k < 1)$$

The "k" denotes a constant which can be operated from the lines D, E and F beforehand. Hence, only if the saturation level Vs2 of the photosensor 15 is measured, the output voltage Vsp, which is obtained when the target toner density Mp is accomplished, can be calculated referring to the equation above. Then, an optimum developing bias voltage for obtaining the target toner density Mp is operated from the voltage Vsp and the voltage Vs1 as which the output of the photosensor 15 is measured when a test toner image is formed with the voltage Vbx of developing bias impressed. Table 1 shows example figures entered in an ROM of a microcomputer 50 to operate an optimum developing bias voltage.

TABLE 1

| Vs2 | 1.0–1.4 | 3.0–3.4 | 4.5–5.0 |
|---|---|---|---|
| Vsp | 0.6–0.8 | 1.8–2.0 | 2.7–3.0 |
| Vs1 | Vb | Vb | Vb |
| 0.6–0.8 | 700 [V] | 900 [V] | |
| 0.9–1.1 | *650 | 850 | 1000 [V] |
| 1.2–1.4 | *650 | 800 | 950 |
| 1.5–1.7 | | 750 | 900 |
| 1.8–2.0 | | 700 | 850 |
| 2.1–2.3 | | 650 | 800 |
| 2.4–2.6 | | 600 | 750 |
| 2.7–2.9 | | 550 | 700 |
| 3.0–3.2 | | *500 | 650 |
| 3.3–3.5 | | *500 | 600 |
| 3.6–3.8 | | | 550 |
| 3.9–4.1 | | | 500 |
| 4.2–4.4 | | | 450 |
| 4.5–5.0 | | | *400 |

According to Table 1, the developing bias voltage Vbx is 700V. When the photosensor's outputs Vs1 and Vsp are equal in voltage, developing bias voltage (Vb) is to be 700V. When the output voltage Vs1 is smaller than Vsp, developing bias voltage (Vb) is to be set larger than 700V. When the output voltage Vs1 is larger than Vsp, developing bias voltage (Vb) is to be set smaller than 700V. In this example, further, the maximum saturation level Vs2 is 5.0V, the constant (k) is 0.6, and the maximum target output voltage Vsp is 3.0V.

In this embodiment, the saturation level Vs2 of the photosensor 15 is measured to operate the voltage Vsp which is supposed to be registered by the photosensor 15 when the target toner density Mp is obtained. Also, the output Vs1 of the photosensor 15 is measured when a test toner image is formed with 700V of developing bias impressed, and an optimum developing bias voltage is figured out from comparison of Vs1 with Vsp, referring to Table 1. The operated developing bias voltage is transmitted to the developing bias power source unit 55 through the feedback system, and the operated value is used for a real copying operation. Thus, a developing bias voltage proper for the charging condition of toner is able to be operated whether the photosensor 15 smudges or not, and it is possible to maintain density of finished images in a specified level.

Incidentally, in a case that the voltage Vs1, which is registered by the photosensor 15 when a test toner image is formed with the voltage Vbx of developing bias impressed, is almost equal to the saturation level Vs2 (for example, in a case that the difference between the voltages Vs1 and Vs2 is smaller than 0.5V), or in a case that there is a big difference between the developing bias voltage Vbx and a calculated developing bias voltage (values provided with the mark * in Table 1), it is difficult to operate a developing bias voltage which enables the target toner density Mp accurately. For this reason, this embodiment further employs a process as described below to figure out an optimum developing bias voltage accurately.

Two kinds of test toner images as described above are formed, and a proper developing bias voltage is operated referring to Table 1. Thereafter, a test toner image is further formed on the photosensitive drum 1 with the operated developing bias voltage impressed, and the toner density is detected with the photosensor 15. The output voltage of the photosensor 15 at that time is referred to as Vs1a. Then, the voltage Vs1a is compared with the target output voltage Vsp operated from the examination of the former test toner images, and an adjusting value (Δ/ Vb) of developing bias voltage is figured out, referring to the following Table 2.

TABLE 2

| Vs2<br>Vsp<br>Vsla | 1.0–1.4<br>0.6–0.8<br>ΔVb | 3.0–3.4<br>1.8–2.0<br>ΔVb | 4.5–5.0<br>2.7–3.0<br>ΔVb |
|---|---|---|---|
| 0.6–0.8 | 0 [V] | | |
| 0.9–1.1 | −50 | 150 [V] | |
| 1.2–1.4 | −100 | 100 | |
| 1.5–1.7 | | 50 | |
| 1.8–2.0 | | 0 | 150 [V] |
| 2.1–2.3 | | −50 | 100 |
| 2.4–2.6 | | −100 | 50 |
| 2.7–2.9 | | −150 | 0 |
| 3.0–3.2 | | | −50 |
| 3.3–3.5 | | | −100 |
| 3.6–3.8 | | | −150 |
| 3.9–4.1 | | | |
| 4.2–4.4 | | | |
| 4.5–5.0 | | | |

The data shown in Table 2 are stored in the ROM of the microcomputer 50 like the data shown in Table 1. A developing bias voltage Vb which was figured out referring to Table 1 is adjusted in accordance with the value /ΔVb which is operated referring to Table 2, and finally a voltage (Vb+ΔVb) is impressed on each of the developing devices as developing bias in a real copying operation. The addition of this process further secures the control of developing bias voltage for obtaining the target toner density Mp.

In a case of reversal development like this embodiment, generally the potential (Vo) to be charged on the photosensitive drum 1 is fixed. In such a case, however, if the difference between the surface potential (Vo) of the background (non-imaged portion) and the developing bias voltage (Vb) is large, carriers will stick to the background, and if the potential difference is small, toner will stick to the background. For this reason, preferably the surface potential (Vo) is changed in accordance with the developing bias voltage (Vb) so that the potential difference (Vo−Vb) is fixed. Table 3 shows surface potential (Vo) proper for developing bias (Vb).

TABLE 3

| Developing Bias Voltage (Vb) | Initial Surface Potential (Vo) |
|---|---|
| 550–700 [V] | 800 [V] |
| 701–800 | 900 |
| 801–900 | 1000 |
| 901–1000 | 1100 |

Figure 8:
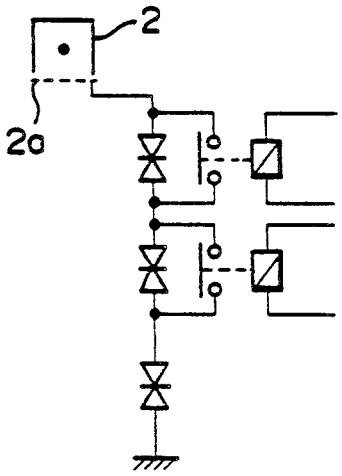
FIG. 8 is a diagram showing a control circuit of an electric charger.
Figure 9:
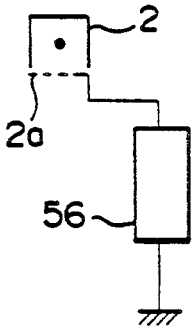
FIG. 9 is a diagram showing another control circuit of the electric charger.

The surface potential (Vo) is altered by controlling the electric charger 2. When using a scorotoron charger as the electric charger 2, varistors directly connected with a grid 2*a* should be switched at the relay contact as shown in FIG. 8, or grid voltage should be adjusted by a high voltage source 56 as shown in FIG. 9.

Incidentally, it takes some time to form a test toner image, detect the toner density and control developing bias voltage in accordance with the detected value for a real copying operation. From the time of developing a test toner image to the time of detecting the toner density, it takes at least the time required for the photosensitive drum 1 to rotate from the developing position Cl to the measuring position C2 shown in FIG. 1. With respect to a copying machine provided with elevator type developing devices which are vertically movable like this embodiment, if a test toner image is formed to adjust developing bias voltage before every cycle of copying operation (charge, exposure, development and transference), it is necessary to consider a time required to set each of the developing devices 3, 4, 5 and 6 to the developing position Cl and a time required to rotate the photosensitive drum 1 from the exposure position CO to the measuring position C2. Further, the elevator type developing devices 3 through 6 may impair an image on the photosensitive drum 1 while they are moving, and to avoid such a trouble, the setting of the developing devices 3 through 6 must be finished before the exposure of a test toner image. Even when the developing devices are not movable, it takes longer to perform one cycle of copying operation with detecting the toner density of a test toner image, at least by the time required for the photosensitive drum 1 to rotate from the developing position Cl to the measuring position C2. Thus, the copying speed becomes lower.

In this embodiment, therefore, test toner formation and toner density detection are performed after the power switch of the copying machine was turned on until a warm-up is completed with charging the heater of the fixing device 46, and immediately after a multiple copying operation is completed (a designated number of copies are made). With this arrangement, test toner formation and toner density detection do not affect the copying speed. When a test toner image is formed after the completion of a multiple copying operation, the test toner image is formed with the developing device which was used last in the multiple copying operation. This arrangement further shortens the time required for test toner image formation and toner density detection.

The result of the toner density detection is used for controlling developing bias voltage (Vb). While a copying operation is performed to make a designated number of copies, impressed as developing bias is the voltage operated based on the toner density detection performed after the former copying operation.

As described above, variations in toner charge (Qf) are related to changes in circumstances such as humidity, temperature, etc., and toner density (M) changes according to the toner charge (Qf). Hence, when there are some differences in circumstances between the time of forming a test toner image and the time of performing the next real copying operation, the target toner density will not be obtained.

In view of this point, when the next copying operation is to be started more than a specified time (To), for example, more than an hour after the last test toner image formation and toner density detection, test toner image formation and toner density detection is newly performed immediately before the copying operation so that developing bias voltage is adjusted to the current conditions. The specified time (To) is to be determined depending on the stability of the circumstances where the full-color copying machine is used, the response characteristic to humidity of the developing powder (mainly the hygroscopicity of the developing powder), etc., and the time (To) actually becomes about an hour. Thus, test toner image formation and toner density detection usually do not affect the copying speed, and further even if the next copying operation is started long after the former operation, the copying machine is capable of appropriately reacting to a change in circumstances, and proper toner density is always obtainable.

Figure 10A:
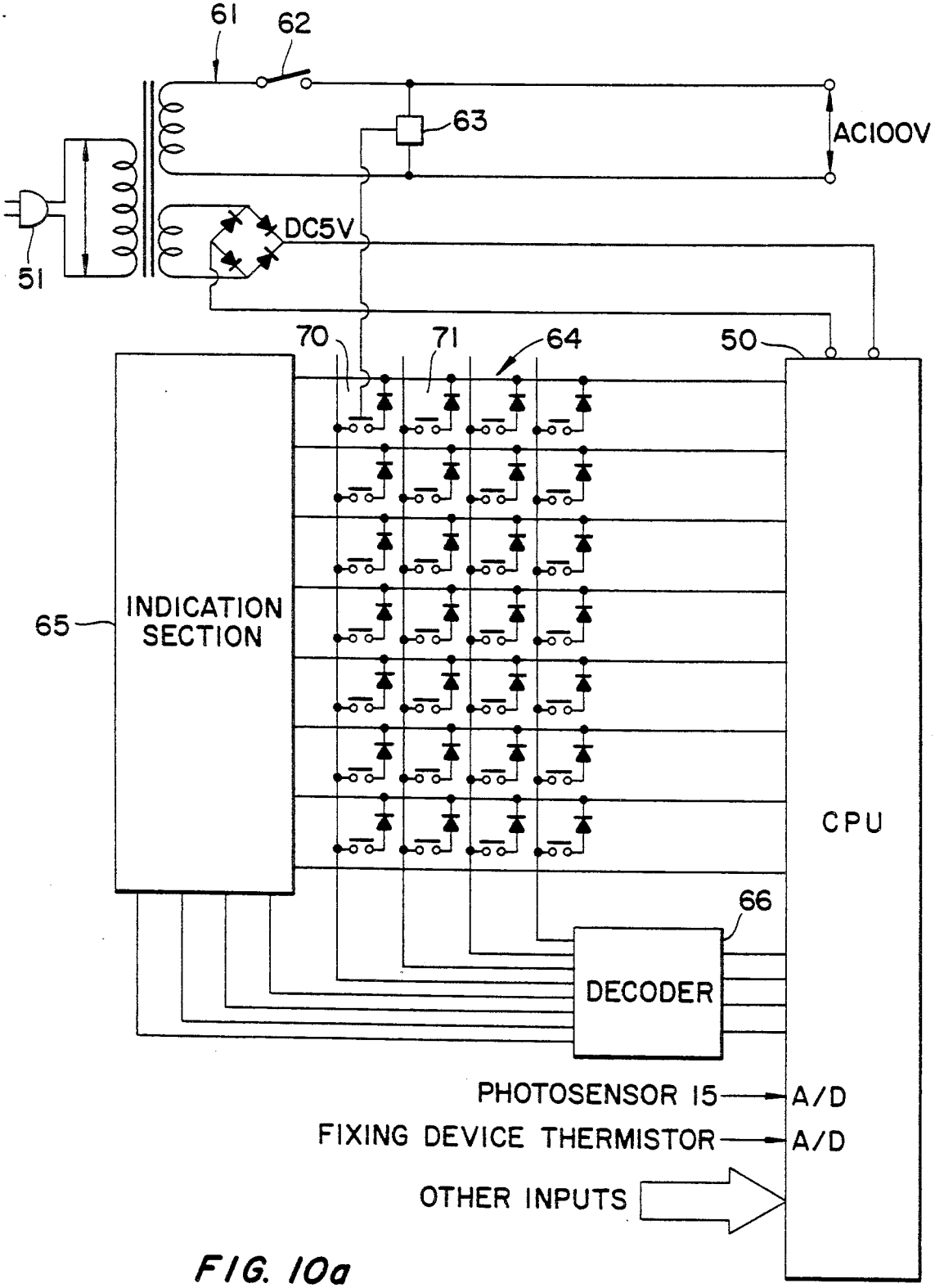
FIG. 10*a* and 10*b* are diagrams showing a control circuitry whose center is a microcomputer.
Figure 10B:
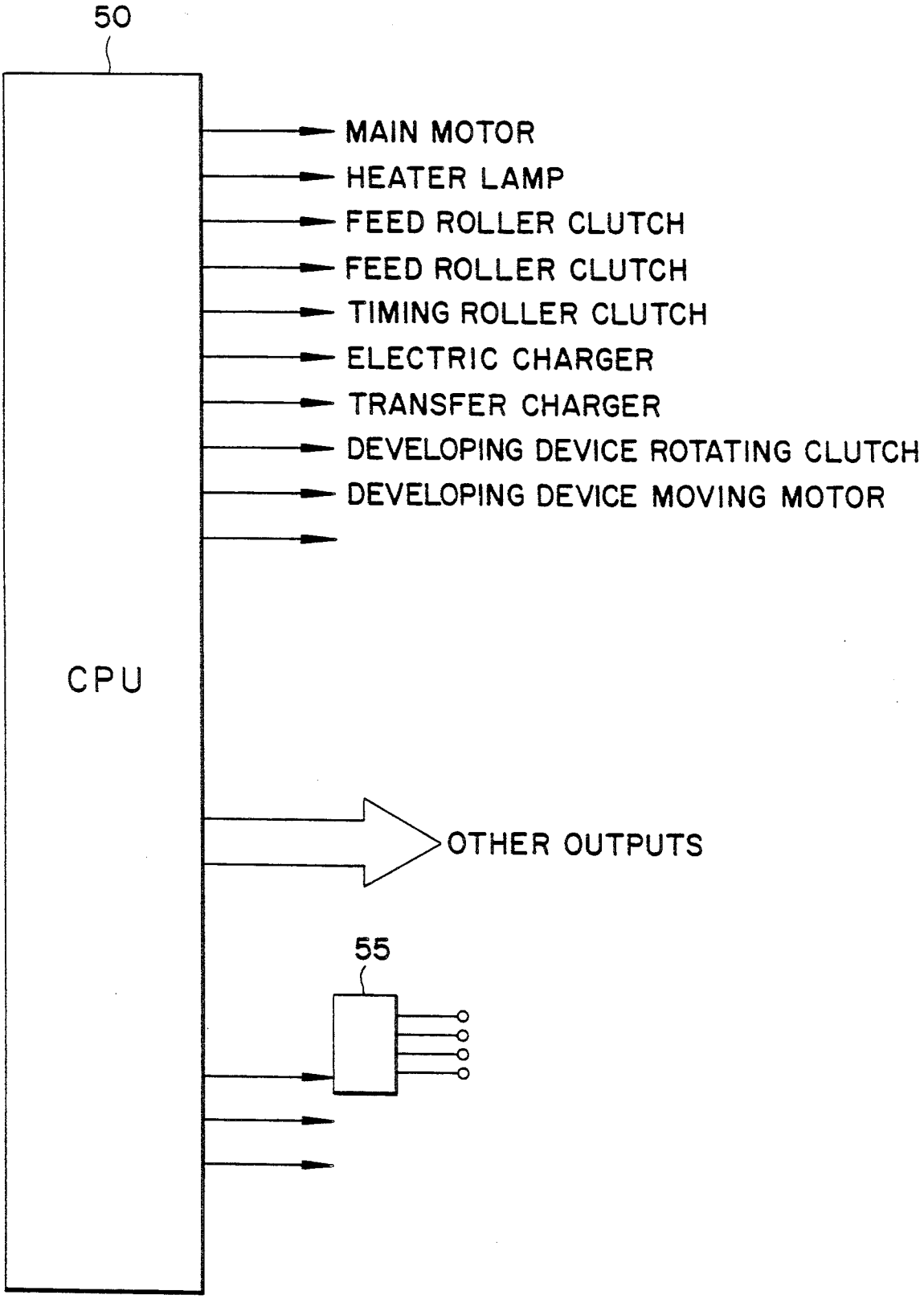

FIGS. 10*a* and 10*b* show a control circuitry of the copying machine.

The microcomputer 50, which has an A/D converter, operates when the copying machine is plugged in, whether a power switch 62 is on or off. This is because the electric current flows through a DC 5V power source in a power source circuit 61. When the power switch 62 is turned on, the main switch 70 for a switch matrix 64 is turned on via a relay 63. The matrix 64 comprises various input means such as a copy switch 71 and an indication section 65. Signals transmitted to the respective switches in the matrix 64 are entered into the microcomputer 50 via a decoder 66. Signals transmitted from the photosensor 15, the thermistor of the fixing device 46, etc. toward the microcomputer 50 are received at an analog port. Drive signals are generated from respective output ports toward the main motor, clutches, etc. of the copying machine.

Next, the control procedure performed by the microcomputer 50 is hereinafter described, but the description is of only the part related to the present invention.

Figure 11:
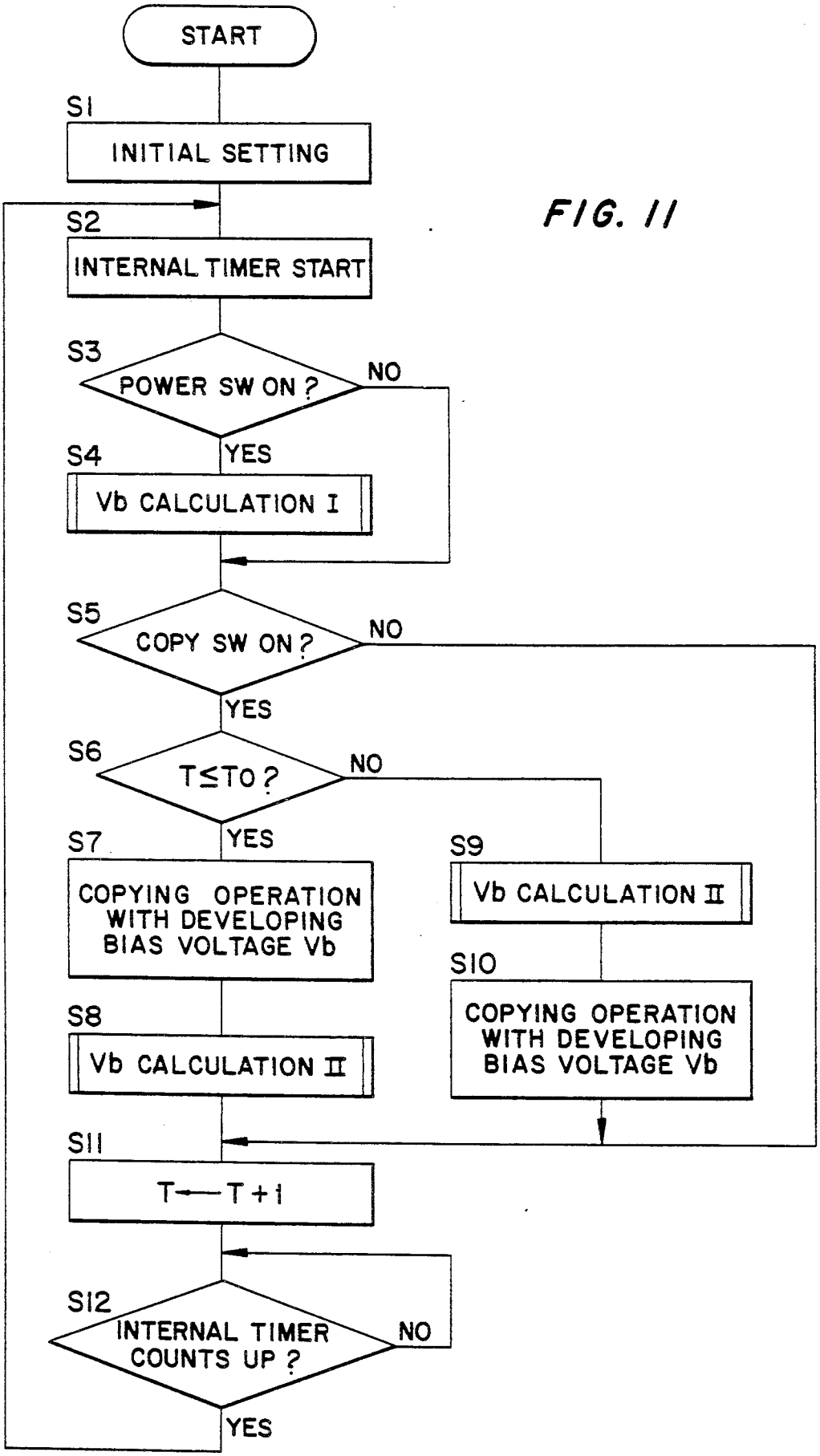
FIG. 11 is a flowchart showing a main routine of the microcomputer.

FIG. 11 shows a main routine. When the microcomputer 50 is reset and the program is started, at step S1 an RAM is cleared, every register is set, and every device is set to the initial mode.

At step S2 an internal timer is started (the timer value was set at step S1), and at step 83 it is judged whether the power switch 62 has been turned on. Only when it is judged the power switch 62 has been turned on, at step S4 a subroutine for calculating a developing bias voltage is called. The developing bias voltage calculation subroutine will be described later.

When it is judged at step S5 that the copy switch 71 has been turned on, it is checked at step S6 whether the count of the timer T is less than the specified time To (in this embodiment, an hour). When the count is less than the specified time To, a subroutine for a copying operation and a subroutine for calculating developing bias voltage are called at steps S7 and S8 respectively. While a copying operation is performed at step S7, the developing bias voltage figured out at step S4 is impressed. The developing bias calculation subroutine at step S8 is the one performed after a copying operation, and more specifically, immediately after the last cycle of copying operation in a copying operation for making a designated number of copies has been competed. On the other hand, the count of the timer T is over the specified time To, the subroutine for calculating developing bias voltage is called at step S9, and the subroutine for a copying operation is called at step S10. The developing bias calculation subroutine at step S9 is performed immediately before starting a copying operation in order to react to a change in circumstances, and the controlling process, which will be described later, is the same as that of the subroutine at step S8.

Next, at step S11 the timer T counts up, and at step S12 the processing waits for the completion of the internal timer. Then, the processing returns to step S2.

Figure 12:
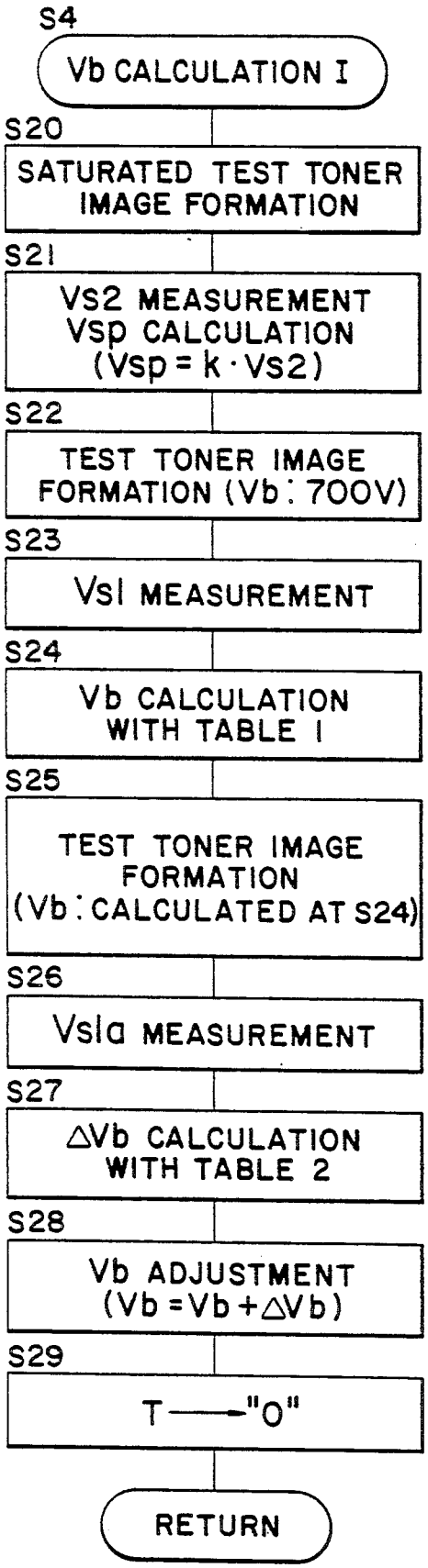
FIG. 12 is a flowchart showing a subroutine to be performed at step S4 in the main routine.

FIG. 12 shows the developing bias voltage calculation subroutine to be performed at step S4. First, at step S20 a solid test toner image in a saturation level is formed, and at step S21 the output voltage Vs2 of the photosensor 15 is measured and the output voltage Vsp which enables the target toner density Mp is calculated. In this embodiment, the initial surface potential of the photosensitive drum 1 is 1100V, and when the photosensitive drum 1 is exposed to the laser beam, the surface potential becomes 200V. A saturated test toner image is formed with 900V of developing bias impressed. Next, at step S22 a half-tone test toner image is formed with a specified voltage (in this embodiment, 700V) of developing bias impressed, and at step S23 the output Vs1 of the photosensor 15 is measured. At step S24 an optimum developing bias voltage (Vb) is calculated from Vsp and Vs1, referring to Table 1.

Further, at step S25 a half-tone test toner image is formed with the developing bias voltage (Vb) calculated at step S24 impressed, and at step S26 the output Vs1a of the photosensor 15 is measured. At step S27 the adjusting value ($\Delta$Vb) of the developing bias voltage (Vb) is calculated from Vsp and Vs1a, referring to Table 2. Then, at step S28 the addition (Vb+$\Delta$Vb) is calculated to adjust the developing bias voltage Vb, and at step S29 the timer T is reset to "0". The developing bias voltage adjusted at step S28 is used in a copying operation performed at step S7.

Figure 13:
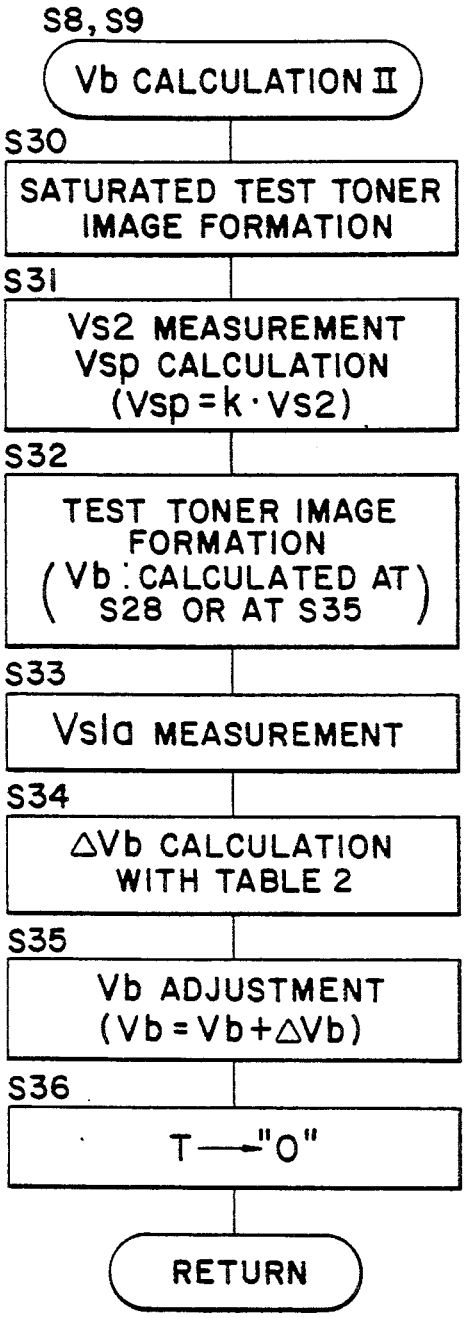
FIG. 13 is a flowchart showing a subroutine to be performed at steps S8 and S9 in the main routine.

FIG. 13 shows the other developing bias voltage calculation subroutine to be performed at steps S8 and S9. At steps S30 and S31, the same processing as steps S20 and S21 is performed. That is, a solid test toner image in a saturation level is formed, the output Vs2 of the photosensor 15 is measured, and the output voltage Vsp of the photosensor 15 which enables the target toner density Mp is figured out. At step S32 a half-tone test toner image is formed with the developing bias voltage calculated last time impressed, and at step S33 the output Vs1a of the photosensor 15 is measured. At step S34 an adjusting value $\Delta$Vb is calculated from Vsp and Vs1a, referring to Table 2. At step S35 the addition (Vb+$\Delta$Vb) is calculated to adjust the developing bias voltage Vb, and at step S36 the timer T is reset to "0".

Incidentally, the present invention has been made based on the inventor's knowledge and experiences as follows. First, it is confirmed by inventor's experiments, where toner densities of images on a photosensitive drum are detected with a photosensor, that the output of the photosensor reaches a saturation level when the toner density comes to a certain level. It is also confirmed by the inventor's experiments that the saturation level of the output of the photosensor varies according to the level of smudges on the photosensor. From these experiments, the inventor gained a concept that the level of smudges on the photosensor can be judged from the saturation level of the output of the photosensor and that accurate toner density can be detected by considering the level of smudges on the photosensor. Specifically, the photosensor registers a voltage of Vs1 when a specified voltage of developing bias is impressed, and the saturation level of the output of the photosensor is Vs2. A photosensor which has no smudges registers a voltage of Vs1' when the specified voltage of developing bias is impressed, and the saturation level of the output of the spotless photosensor is Vs2'. The correlation among these values can be indicated by the following equations:

$$Vs1/Vs2 = Vs1'/Vs2'$$

$$Vs1' = (Vs1 \cdot Vs2')/Vs2$$

The value Vs2' is obtainable from experiments beforehand. By measuring the value Vs2, the level of smudges on the photosensor can be judged, and further by measuring the value Vs1 and adopting the values Vs2 and Vs1 to the equation above, the value Vs1' can be calculated. Then, the toner density at that time is accurately detected referring to Table 4.

By following the above-described procedure, it becomes possible to detect toner density accurately in spite of smudges on the photosensor. Also, because this method does not depend on reflected light from the photosensitive drum, the detection of toner density is not influenced by smudges and scratches on the photosensitive drum. Further, the value Vsp/Vs2 is always fixed regardless of changes in characteristic of the toner. Hence, even when the characteristic of the toner changes due to a change in circumstances such as temperature, humidity, etc., the toner density is detected accurately.

TABLE 4

| Vs2 | 1.3 | | ... | 3.2 | | ... | 4.3 | | ... | 4.7 | |
|---|---|---|---|---|---|---|---|---|---|---|---|
| Vsl | Vsl' | toner density | | Vsl' | toner density | | Vsl' | toner density | | Vsl' | toner density |
| 0.7 | 2.5 [V] | 0.9 [mg] | | 0.9 | 0.4 | | 0.7 | 0.3 | | | |
| 1.0 | | | | 1.3 | 0.5 | | 1.0 | 0.4 | | 0.9 | 0.4 |
| 1.3 | | | | 1.7 | 0.6 | | 1.3 | 0.5 | | 1.2 | 0.5 |
| 1.6 | | | | 2.2 | 0.8 | | 1.6 | 0.6 | | 1.5 | 0.6 |
| 1.9 | | | | 2.6 | 0.9 | | 1.9 | 0.7 | | 1.7 | 0.6 |
| 2.2 | | | | 3.0 | 1.1 | | 2.2 | 0.8 | | 2.0 | 0.7 |
| 2.5 | | | | 3.4 | 1.2 | | 2.5 | 0.9 | | 2.3 | 0.8 |
| 2.8 | | | | 3.8 | 1.3 | | 2.8 | 1.0 | | 2.6 | 0.9 |
| 3.1 | | | | 4.2 | 1.5 | | 3.1 | 1.1 | | 2.8 | 1.0 |
| 3.4 | | | | | | | 3.4 | 1.2 | | 3.1 | 1.1 |
| 3.7 | | | | | | | 3.7 | 1.3 | | 3.4 | 1.2 |
| 4.0 | | | | | | | 4.0 | 1.4 | | 3.7 | 1.3 |
| 4.3 | | | | | | | 4.3 | 1.5 | | 3.9 | 1.4 |
| 4.7 | | | | | | | | | | 4.3 | 1.5 |

Although the present invention has been described in connection with the embodiment above, it is to be noted that various changes and modifications are apparent to those who are skilled in the art. Such changes and modifications are to be understood as included within a scope of the present invention as defined by the appended claims.

For example, the copying machine itself may be any type. Although the copying machine described in the embodiment is full-color type, a monocolor copying machine can be used. Also, a visible radiation type optical system may be used instead of the laser beam type optical system. With respect to the control procedure shown by the flowcharts, the developing bias voltage calculation subroutine to be performed at steps S8 and S9 may be replaced with the developing bias voltage calculation subroutine performed at step S4.

The detected toner density of a standard test toner image may be used for controlling the toner supply device, the exposure adjusting device and the electric charger as well as the developing bias adjusting device.

When a second test toner image is formed in addition to a first test toner image so that the developing bias voltage can be adjusted more exactly, there are various means and methods of detecting the toner densities of the test toner images as well as the means and method wherein the amount of diffused light from each toner image is measured. For instance, the amount of regular reflection from each of the toner images may be measured, and it is possible to detect the toner density in a method other than an optical method.

What is claimed is:

1. A method of detecting the toner density of a standard test toner image formed on an image recording member, comprising the following steps of:

forming on the image recording member a saturated test toner image from which the amount of diffused light is to be measured as a saturation level as well as the standard test toner image;

measuring the amount of diffused light from the saturated toner image;

measuring the amount of diffused light from the standard test toner image; and evaluating the measurement of the amount of diffused light from the standard test toner image in accordance with the measurement of the amount of diffused light from the saturated test toner image.

2. A toner density detecting method as claimed in claim 1, wherein said evaluating step includes a step of comparing the measurement of the amount of diffused light from the saturated test toner image with a predetermined standard value and a step of revising the measurement of the amount of diffused light from the standard test toner image in accordance with the result of the comparison.

3. An image forming method where an electrostatic latent image is formed on an image recording member, the latent image is developed into a toner image by a developing device with a developing bias voltage impressed, and the toner image is transferred onto a copy sheet, the image forming method comprising the following steps of:

forming on the image recording member a saturated test toner image from which the amount of diffused light is to be measured as a saturation level;

measuring the amount of diffused light from the saturated test toner image;

forming a standard test toner image on the image recording member with a specified voltage of developing bias impressed;

measuring the amount of diffused light from the standard test toner image; and determining an optimum developing bias voltage depending on the measurement of the amount of diffused light from the saturated toner image and the measurement of the amount of diffused light from the standard test toner image.

4. An image forming method as claimed in claim 3, wherein the developing bias voltage determining step includes a step of calculating a standard value corresponding to a target toner density from the measurement of the amount of diffused light from the saturated test toner image and a step of comparing the calculated standard value with the measurement of the amount of diffused light from the standard test toner image.

5. An image forming method as claimed in claim 3, further comprising the following steps of:

forming another standard test toner image with the determined voltage of developing bias impressed;

measuring the amount of diffused light from the newly formed standard test toner image; and adjusting the developing bias voltage determined in the developing bias voltage determining step in accordance with the measurement of the amount of diffused light from the saturated test toner image and the measurement of the amount of diffused light from the newly formed standard test toner image.

6. An image forming method as claimed in claim 3, further comprising a step of forming an image wherein a specified electrostatic latent image is formed on the image recording member and the latent image is developed with a developing bias voltage impressed, wherein the processing proceeds through the test toner image forming step, the diffused light measuring step and the developing bias voltage determining step prior to said image forming step.

7. An image forming method as claimed in claim 6, wherein the processing proceeds through the test toner image forming step, the diffused light measuring step and the developing bias voltage determining step immediately after a power supply for the image forming apparatus.

8. An image forming method as claimed in claim 3, further comprising a step of forming an image wherein a specified electrostatic latent image is formed on an image recording member and the latent image is developed with a developing bias voltage impressed, the processing proceeds through the test toner image forming step, the diffused light measuring step and the developing bias voltage determining step immediately after said image forming step.

9. An image forming method as claimed in claim 3, further comprising the following steps of:

forming an image wherein a specified electrostatic latent image is formed on the image recording member and the latent image is developed with a developing bias voltage impressed; and counting an interval at which the processing occurs the image forming step, wherein when the processing in the image forming step is at an interval of more than a specified time, the processing proceeds through the test toner image forming step, the diffused light measuring step and the developing bias determining step immediately before the image forming step.

10. Image forming apparatus, comprising:

a photosensitive member;

means for irradiating the photosensitive member to form an electrostatic latent image thereon;

means for developing the electrostatic latent image on the photosensitive member into a toner image, the means including developing bias impressing means;

means for altering voltages to be impressed by the developing bias impressing means;

means for measuring the amount of diffused light from toner stuck on the photosensitive drum;

means for forming a saturated test toner image from which the amount of diffused light is to be measured as a saturation level;

means for forming a standard test toner image with a specified voltage of developing bias impressed;

means for calculating a developing bias voltage from the measurement of the amount of diffused light from the saturated test toner image and the measurement of the amount of diffused light from the standard test toner image; and means for controlling the developing bias voltage altering mean in accordance with the result of the developing bias voltage calculating means.

11. Image forming apparatus as claimed in claim 10, wherein the developing bias voltage calculating means calculates a standard value corresponding to a target toner density from the measurement of the amount of diffused light from the saturated test toner image, and compares the calculated standard value with the measurement of the amount of diffused light from the standard test toner image to figure out an optimum developing bias voltage.

12. Image forming apparatus as claimed in claim 10, further comprising:

means for forming another standard test toner image with the developing bias voltage calculated by the calculating means impressed; and means for adjusting the developing bias voltage calculated by the calculating means, in accordance with the measurement of the amount of diffused light from the saturated test toner image and the measurement of the amount of diffused light from the newly formed standard test toner image.

13. Image forming apparatus as claimed in claim 10, wherein the test toner image forming means, the diffused light measuring means and the developing bias calculating means are operated immediately after a power supply for the image forming apparatus.

14. Image forming apparatus as claimed in claim 10, wherein the test toner image forming means, the diffused light measuring means and the developing bias voltage calculating means are operated immediately after an image forming operation.

15. Image forming apparatus as claimed in claim 10, further comprising:

means for counting an interval between image forming operations; and control means for when an image forming operation is to be started more than specified time after the former image forming operation, actuating the test toner image forming means, the diffused light measuring means and the developing bias voltage calculating means immediately before the image forming operation.

16. Image forming apparatus, comprising:

a photosensitive member;

means for irradiating the photosensitive member to form an electrostatic latent image thereon;

means for developing the electrostatic latent image on the photosensitive member into a toner image, the means including developing bias impressing means;

means for altering voltages to be impressed by the developing bias impressing means;

means for forming a test toner image on the photosensitive member;

means for measuring the toner density of the test toner image formed on the photosensitive member;

means for calculating a developing bias voltage which enables a target toner density from the measurement of the toner density of the test toner image; and control means for forming a second test toner image with the developing bias voltage calculated by the calculating means impressed, measuring the toner density of the second test toner image, calculating an adjusting value of the developing bias voltage, and controlling the developing bias voltage altering means in accordance with the calculated adjusting value.

17. Image forming apparatus as claimed in claim 16, further comprising second control means for actuating the test toner image forming means, the toner density measuring means and the developing bias voltage calculating means before an image forming operation.

18. Image forming apparatus as claimed in claim 17, wherein the second control means actuates the test tour image forming means, the toner density measuring means and the developing bias voltage calculating means immediately after a power supply for the image forming apparatus.

19. Image forming apparatus as claimed in claim 16, further comprising second control means for actuating the test toner image forming means, the toner density measuring means and the developing bias voltage calculating means immediately after an image forming operation.

20. Image forming apparatus as claimed in claim 16, further comprising:

means for counting an interval between image forming operations; and second control means for when an image forming operation is to be started more than a specified time after the former image forming operation, actuating the test toner image forming means, the toner density measuring means and the developing bias voltage calculating means immediately before the image forming operation.

21. Image forming apparatus, comprising:

a photosensitive member;

means for irradiating the photosensitive member to form an electrostatic latent image thereon;

means for developing the electrostatic latent image on the photosensitive member into a toner image, the means including developing bias impressing means;

means for altering voltages to be impressed by the developing bias impressing means;

means for forming a test toner image on the photosensitive member;

means for measuring the toner density of the test toner image formed on the photosensitive member;

first control means for calculating a developing bias voltage which enables a target toner density from the measurement of the toner density of the test toner image and controlling the developing bias altering means;

means for counting an interval between image forming operations; and second control means for actuating the test toner image forming means, the toner density measuring means and the developing bias voltage calculating means immediately after a power supply for the image forming apparatus and image forming operation, and when an image forming operation is to be started more than a specified time after the former image forming operation, actuating the test toner image forming means, the toner density measuring means and the developing bias voltage calculating means immediately before the image forming operation.

* * * * *